US008160463B2

(12) United States Patent
Takahashi et al.

(10) Patent No.: US 8,160,463 B2
(45) Date of Patent: Apr. 17, 2012

(54) IMAGE FORMING APPARATUS

(75) Inventors: Katsunori Takahashi, Hino (JP); Toshihiro Motoi, Tokyo (JP); Kenji Yamamoto, Hachioji (JP); Akifumi Isobe, Hidaka (JP); Eiji Nishikawa, Tachikawa (JP); Kosuke Masumoto, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 183 days.

(21) Appl. No.: 12/759,056

(22) Filed: Apr. 13, 2010

(65) Prior Publication Data

US 2010/0266298 A1 Oct. 21, 2010

(30) Foreign Application Priority Data

Apr. 20, 2009 (JP) ..... 2009-101926

(51) Int. Cl.
*G03G 15/00* (2006.01)

(52) U.S. Cl. ..... 399/36; 399/167

(58) Field of Classification Search ..... 399/36, 399/77, 167

See application file for complete search history.

(56) References Cited

U.S. PATENT DOCUMENTS 6,501,930 B2 * 12/2002 Oku ..... 399/167
6,725,005 B2 * 4/2004 Ueda et al. ..... 399/167
7,606,516 B2 * 10/2009 Ueda et al. ..... 399/167

FOREIGN PATENT DOCUMENTS

JP 6-327278 A 11/1994
JP 2003-186368 A 7/2003

* cited by examiner

*Primary Examiner* — Hoang Ngo

(74) *Attorney, Agent, or Firm* — Holtz, Holtz, Goodman & Chick, PC

(57) ABSTRACT

Disclosed is an image forming apparatus, which makes it possible to appropriately conduct a controlling operation for eliminating the velocity fluctuation of the photoreceptor drum without generating any malfunction. The apparatus includes a photoreceptor member driven by a motor and a control section that is provided with a feed forward controlling section that stores parameters derived from driving errors for one revolution of the photoreceptor member to create a reverse-phase instruction value based on the parameters and a feedback controlling section that controls a velocity of the photoreceptor member, so as to keep the velocity of the photoreceptor member constant. During an initial operating time, the control section deactivates the feed forward controlling section, while only activates the feedback controlling section to drive the photoreceptor member so as to measure a driving toque of the driving motor, and selects a parameter from the parameters, corresponding to the driving toque measured.

7 Claims, 6 Drawing Sheets

IMAGE FORMING APPARATUS

This application is based on Japanese Patent Application NO. 2009-101926 filed on Apr. 20, 2009, with Japan Patent Office, the entire content of which is hereby incorporated by reference.

BACKGROUND OF THE INVENTION

The present invention relates to an image forming apparatus that conducts an image forming operation based on the electro-photographic process so as to form a toner image onto a circumferential surface of a rotating photoreceptor drum, and specifically relates to a rotation driving control operation for controlling the rotating velocity of the photoreceptor drum so as to keep it constant.

In the image forming apparatus employing the electro-photographic process, an image is formed on a recording medium in such a manner that a toner image is formed on a image bearing member, such as the rotating photoreceptor drum, a photoreceptor belt, etc., and then, the toner image formed on the image bearing member is directly or indirectly transferred onto the recording medium, and further, the toner image residing on the recording medium is fixed thereon.

In the event of performing the abovementioned image forming operation, if the velocity of the image bearing member, which is to be rotated at a constant velocity when a latent image is formed by the image exposing operation conducted by an exposing device, fluctuates, distortions in the sub-scanning direction are generated on the image to be formed.

Further, in a color image forming apparatus employing a tandem image forming method, a full color toner image is formed on a recording paper sheet by superimposing unicolor toner images, which are formed by a plurality of unicolor toner-image forming units, respectively. Accordingly, it has been an indispensable condition for acquiring a good color image that the image bearing members provided in the plurality of unicolor toner-image forming units should be rotated at the same velocity without generating any velocity unevenness. Therefore, if the velocities of the image bearing members provided in the plurality of unicolor toner-image forming units are different from each other, color deviations would be generated.

So far, with respect to the method for controlling the velocity of the photoreceptor drum, there has been proposed various kinds of controlling methods. Among other thing, when trying to control the angular velocity of the photoreceptor drum in real time mode so as to keep it at a constant velocity, there has been employed the rotation velocity controlling method for conducting the rotation velocity controlling operation by using the angular velocity detecting element, such as an encoder.

In this connection, with respect to the above-kind of rotation velocity controlling operation, the proposals for conducting efficient processing are set forth in Tokkaihei 6-327278 and Tokkai 2003-186368 (both are Japanese Patent Application Laid-Open Publications).

With respect to the angular velocity controlling operation, the above-cited Tokkalhei 6-327278 sets forth such a proposal that the profile of the rotation unevenness of the photoreceptor drum concerned is measured at a certain time point by using the feedback control or the feed forward control so as to employ the data of the profile for the angular velocity controlling operation until the predetermined next sampling time will arrive.

Further, the above-cited Tokkai 2003-186368 sets forth such a proposal that, when the angular velocity controlling operation of the photoreceptor drum is performed by employing both the feedback control and the feed forward control, the driving operation at the present drum position is performed by referring the deviation value of the angular velocity derived from that of one revolution before, while continuously updating the angular velocity profile stored in the memory, so as to abruptly converge the unevenness (fluctuation) of the angular velocity onto the constant value.

Incidentally, it is performed that the residual toner remaining on the circumferential surface of the photoreceptor drum is removed by press-contacting the cleaning blade onto the photoreceptor drum. On that occasion, the abrasive load generated between the circumferential surface of the photoreceptor drum and the cleaning blade is greatly fluctuated by various kinds of factors, such as environmental conditions, an image forming history, a characteristic aging variation of the cleaning blade, etc. Accordingly, the feedback controlling method is employed so as to rotate the photoreceptor drum at the predetermined constant velocity, even if such the fluctuation of the abrasive load is generated.

The present inventors have revealed that, when the fluctuation of the abrasive load is generated as abovementioned, a certain inconvenience occurs in the rotation velocity controlling operation that employs the feed forward control method. This inconvenience will be detailed in the following.

FIG. 5*a* shows a graph indicating a transition of the rotation velocity exhibiting a repeatable fluctuation that occurs every one revolution of the photoreceptor drum. In this connection, the broken line indicates a command velocity instructed by the controlling section. Further, in order to make the explanation simple, fine velocity fluctuations and other velocity fluctuations having no repeatability are omitted from the graphs.

With respect to such the velocity fluctuation having the repeatability, in order to generate a waveform having a phase being reverse to that of the waveform indicated in FIG. 5*a*, taking the phase delay component into account, the instruction value waveform, having a phase that is slightly advanced from the reverse phase, is created as shown in FIG. 5*b*. Successively, based on the above-mentioned instruction value waveform, the waveform having the reverse phase is generated as shown in FIG. 5*c*. Still successively, by employing the above-generated waveform as the instruction value for canceling the velocity fluctuation, it becomes possible to acquire the constant rotation velocity of the photoreceptor drum as shown in FIG. 5*d*, indicating a state that the velocity fluctuation is cancelled.

FIG. 6*a* shows a graph indicating a transition of the rotation velocity exhibiting a repeatable fluctuation that occurs every one revolution of the photoreceptor drum. In this connection, the broken line indicates a command velocity instructed by the controlling section. Further, in order to make the explanation simple, fine velocity fluctuations and other velocity fluctuations having no repeatability are omitted from the graphs.

With respect to such the velocity fluctuation having the repeatability, in order to generate a waveform having a phase being reverse to that of the waveform indicated in FIG. 6*a*, taking the phase delay component into account, the instruction value waveform, having a phase that is slightly advanced from the reverse phase, is created as shown in FIG. 6*b*.

Successively, based on the abovementioned instruction value waveform, the waveform having the reverse phase, indicated by the bold broken line c1 shown in FIG. 6*c*, is scheduled to be generated. In this connection, when the load for the photoreceptor drum reduces, the toque of the driving motor for driving the photoreceptor drum is also getting small. For this reason, based on the instruction value, shown in FIG. 6*b*, which is found in the state that the normal toque is assumed, the instruction value of the reverse waveform is getting large relative to the lowered toque, as indicated by the bold solid line c2 shown in FIG. 6*c*, and as a result, the reverse waveform, having an amplitude being larger than the scheduled amplitude, is generated. Still successively, by employing the above-generated reverse waveform as the instruction value for canceling the velocity fluctuation, the rotation velocity of the photoreceptor drum as shown in FIG. 6*d*, indicating a state that the rotation velocity is greatly fluctuated in a direction reverse to that of the original velocity fluctuation, could be obtained.

In other words, when the fluctuation of the load is generated in the photoreceptor drum, the feed forward controlling operation is not appropriately performed. Further, in this case, the feed forward controlling system may oscillate, and as a result, sometimes, the driving motor would be stopped by the abnormal drive malfunction caused by the vibrations, etc.

Further, in order to prevent the occurrence of the abovementioned inconvenience, such as the oscillation, etc., it may be possible to determine parameters to be used for the feed forward controlling operation, in a state that gain of the system is made to reduce in advance. However, in that case, although no malfunction, such as the oscillation, etc., is generated, the effect of the feed forward controlling operation becomes weak. Accordingly, there have arisen new problems that the effect of suppressing the periodical velocity fluctuation is small, and/or the suppressing operation consumes much time or the like.

SUMMARY OF THE INVENTION

To overcome the abovementioned drawbacks in conventional image forming apparatuses, it is one of objects of the present invention to provide an image forming apparatus, which makes it possible to appropriately conduct a controlling operation for eliminating the velocity fluctuation of the photoreceptor drum without generating any malfunction, such as a controlling failure, etc., when the controlling operation is actually implemented.

Accordingly, at least one of the objects of the present invention can be attained by any one of the image forming apparatuses described as follows.

(1) According to an image forming apparatus reflecting an aspect of the present invention, the image forming apparatus, comprises: a photoreceptor member that is driven by a driving motor to form an image thereon; and a control section to control the driving motor so as to drive the photoreceptor member at a constant velocity, wherein the control section is provided with: a feed forward controlling section that stores parameters derived from driving errors for one revolution of the photoreceptor member, acquired in a past, so as to create a reverse-phase instruction value for canceling a driving error, based on one of the parameters; and a feedback controlling section that controls a velocity of the photoreceptor member, corresponding to a velocity instruction value, the reverse-phase instruction value and a detected result of a driving status of the photoreceptor member, so as to keep the velocity of the photoreceptor member constant; and wherein, during an initial operating time, the control section deactivates the feed forward controlling section, while only activates the feedback controlling section to drive the photoreceptor member so as to measure a driving toque of the driving motor, and selects a first parameter from the parameters, corresponding to the driving toque measured; and wherein, after the that parameter is selected, the control section activates both the feed forward controlling section, which employs the first parameter, and the feedback controlling section, to drive the photoreceptor member so as to conduct an image forming operation for forming the image thereon.

(2) According to another aspect of the present invention, in the image forming apparatus recited in item 1, the control section controls various kinds of concerned sections provided in the image forming apparatus, so as to implement a color registration adjustment in such a state that both the feed forward controlling section, which employs the first parameter, and the feedback controlling section are activated to drive the photoreceptor member.

(3) According to still another aspect of the present invention, in the image forming apparatus recited in item 1 or item 2, the control section measures a currently driving toque of the driving motor in midcourse of conducting the image forming operation; and, in a case that the currently driving toque, measured in midcourse of conducting the image forming operation, is varied from the driving toque measured at a time point when the first parameter was selected, and a difference between the currently driving toque and the driving toque is equal to or greater than a predetermined value, the control section reselects a second parameter from the parameters.

(4) According to still another aspect of the present invention, in the image forming apparatus recited in item 3, the control section makes the second parameter effective, after the image forming operation, being currently implemented, is completed.

(5) According to still another aspect of the present invention, in the image forming apparatus recited in item 4, the control section implements a next image forming operation in such a state that both the feed forward controlling section, which employs the second parameter, and the feedback controlling section are stabilized after the second parameter is made to be effective.

(6) According to still another aspect of the present invention, in the image forming apparatus recited in any one of items 1-5, the control section calculates the driving toque from a PWM (Pulse Width Modulation) instruction value to be fed to the driving motor and a velocity value of the driving motor.

(7) According to yet another aspect of the present invention, in the image forming apparatus recited in item 6, with respect to the driving toque calculated, the control section employs a value found by averaging toque for one revolution of the photoreceptor member.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
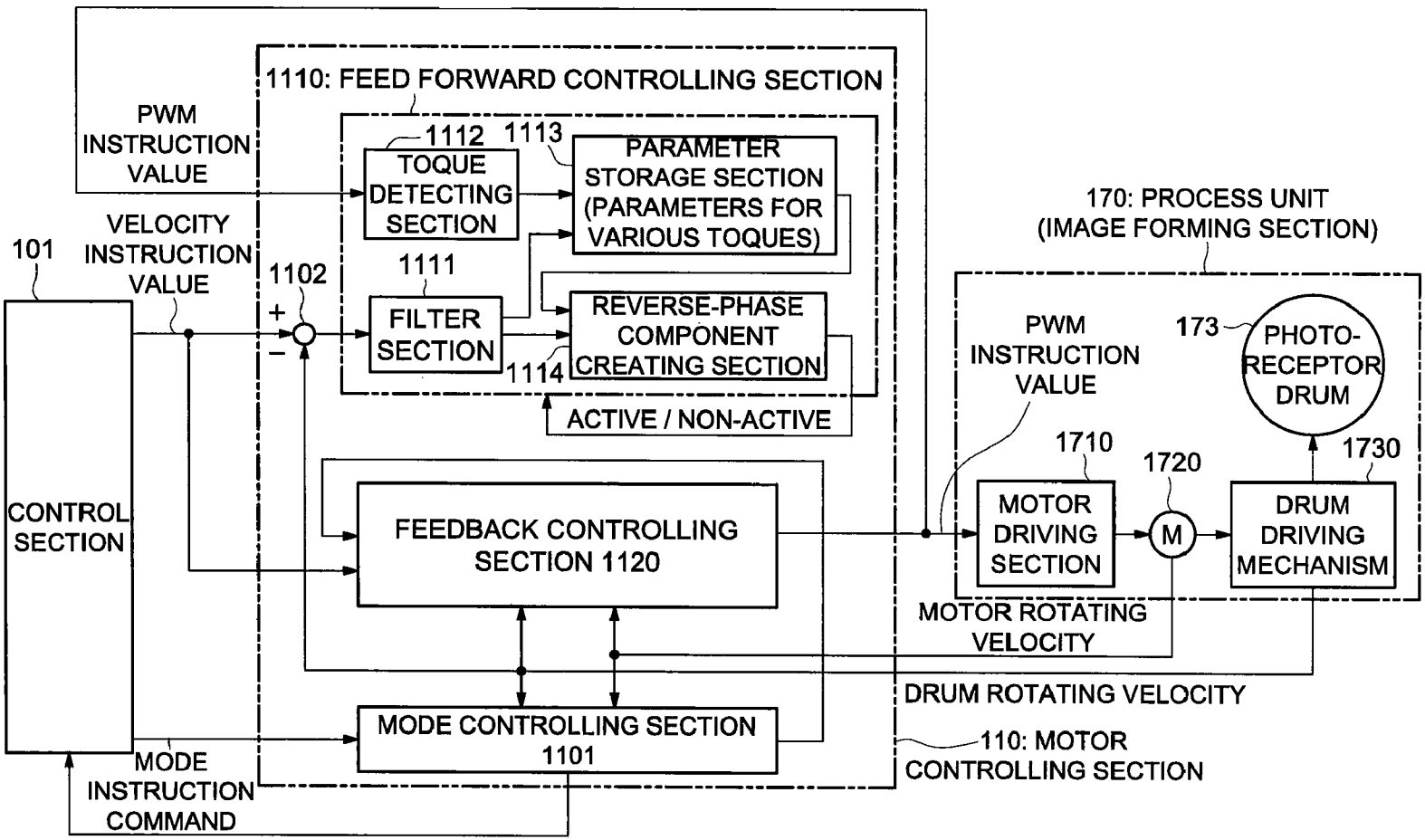
FIG. 1 shows a schematic diagram indicating a rough configuration of an image forming apparatus embodied in the present invention.

Referring to the drawings, the image forming apparatus, embodied in the present invention as the preferred embodiment, will be detailed in the following.

<Configuration of Image Forming Apparatus 100>

Now, referring to FIG. 1 and FIG. 2, a configuration of an image forming apparatus 100 embodied in the present invention as the that embodiment, which employs the electrophotographic method, will be detailed in the following. In this connection, explanations for general purpose sections, which are well-known as the functional sections to be provided in the image forming apparatus 100 and does not directly relate to the operations and controlling operations being characteristic in the present embodiment, will be omitted from the following descriptions.

Further, the schematic diagram shown in FIG. 1 indicates the configuration of the image forming unit for forming a single unicolor (a single primary color) image, and in the case of color image forming apparatus, a plurality of image fanning units for respectively forming unicolor (primary color) images are configured so as to form a full color image.

The image forming apparatus 100, embodied in the present invention, is constituted by: a control section 101 that includes a CPU (Central Processing Unit) etc., to control various kinds of sections; a motor controlling section 110 to control a driving status of a motor that drives the photoreceptor drum to rotate; an image forming section 170 (hereinafter, also referred to as a process unit 170) to form an image onto a recording paper sheet through the processes of forming a toner image on a photoreceptor element, such as a rotating photoreceptor drum, a photoreceptor belt, etc., transferring the toner image formed on the photoreceptor element directly or indirectly onto the recording paper sheet, and further, fixing the toner image onto the recording paper sheet. In this connection, a combination of the control section 101 and the motor controlling section 110 is defined as a control section recited in the claims.

Based on the OS (Operating System) or the firmware installed in advance, the control section 101 executes various kinds of control programs so as to control various kinds of sections constituting the image forming apparatus 100, and performs various kinds of arithmetic calculation processing so as to totally control the image forming apparatus as a whole.

Further, in the first embodiment of the present invention, the control section 101 outputs a velocity instruction command in regard to the rotation velocity of the motor for driving the photoreceptor drum and a mode instruction command for instructing how to implement any one of the feed forward controlling operation and the feedback controlling operation.

The motor controlling section 110 is constituted by a mode controlling section 1101 to control statuses of both the feed forward controlling operation and the feedback controlling operation; a feed forward controlling section 1110 that conducts the feed forward controlling operation to create a reverse phase instruction value opposing to the periodical velocity fluctuation having a repeatability; and a feedback controlling section 1120 that conducts the feedback controlling operation so as to keep the rotation velocity of the motor constant, opposing to various kinds of velocity fluctuation factors.

Based on the mode instruction command sent from the control section 101, the mode controlling section 1101 controls the statuses of the feed forward controlling section 1110 and the feedback controlling section 1120, with respect to how to implement any one of the feed forward controlling operation and the feedback controlling operation. An error value creating section 1102 creates a difference between an instructed velocity value and the actual motor rotation velocity so as to output the difference value to the feed forward controlling section 1110 as an error value.

The feed forward controlling section 1110 is provided with a filter section 1111, a toque detecting section 1112, a parameter storage section 1113 and a reverse-phase component creating section 1114.

The filter section 1111 applies either a low-pass filter or a predetermined band-pass filter to the error value between the instructed velocity value and the actual motor rotation velocity, so as to output a driving error profile for one revolution of the photoreceptor drum.

The toque detecting section 1112 finds the driving toque of the motor from the PWM (Pulse Width Modulation) instruction value for the motor driving section and the velocity control rotation number at present, and from the PWM toque table for each velocity that is provided in advance as a table.

The parameter storage section 1113 retains parameters based on the driving error for one revolution of the photoreceptor drum acquired in the past, as such the parameters that are necessary to eliminate (cancel) the periodical velocity fluctuation having a repeatability. The parameters retained in the parameter storage section 1113 respectively correspond to gain values being different from each other, so as to make the parameters respectively correspond in the different motor toques without generating any deficiency and excess. Accordingly, the parameter storage section 1113 can output an appropriate parameter corresponding to the toque detected by the toque detecting section 1112.

The reverse-phase component creating section 1114 receives the velocity instruction command passing through the filter section 1111 and the parameter corresponding to the toque from the parameter storage section 1113, so as to create the reverse instruction value for canceling the periodical velocity fluctuation having a repeatability.

In response to the velocity instruction value outputted from the control section 101, the reverse instruction value outputted from the feed forward controlling section 1110 and the detecting results of the driving statuses of the motor and the photoreceptor drum (detailed later), the feedback controlling section 1120 outputs the PWM instruction value for keeping the rotation velocity of the photoreceptor drum constant. In this connection, hereinafter in the present embodiment, the PWM instruction value is defined as a PWM duty-cycle instruction value for controlling the duty-cycle of the pulses to be generated in the Pulse Width Modulation mode.

The image forming section 170 is provided with a motor driving section 1710, a motor 1720, a drum driving mechanism 1730 and a photoreceptor drum 173.

Receiving the PWM instruction value sent from the motor controlling section 110, the motor driving section 1710 generates PWM signals having a frequency and a duty-cycle corresponding to the PWM instruction value concerned so as to supply the PWM signals to the motor 1720.

Receiving the PWM signals outputted from the motor driving section 1710, the motor 1720 rotates at a predetermined rotation number (rotating velocity).

In response to the rotating action of the motor 1720, the drum driving mechanism 1730 make the photoreceptor drum 173 rotate at a predetermined rotating velocity through various kinds of velocity changing mechanism, various kinds of clutches, etc.

Further, an encoder is disposed at a position between the motor 1720 and the drum driving mechanism 1730, so as to supply both the motor rotating velocity signal and the drum rotating velocity signal to the feedback controlling section 1120.

In this connection, when the image forming apparatus 100 serves as a color image forming apparatus that is capable of forming a full color image, the motor controlling sections 110 is configured so as to correspond to the plural unicolors (for instance, four primary colors of Y (Yellow), M (Magenta), C (Cyan) and K (Black)). As well as the above, with respect to the image forming section 170, each of the motor driving section 1710, the motor 1720, the drum driving mechanism 1730 and the photoreceptor drum 173 is configured so as to correspond to the plural unicolors (for instance, four primary colors of Y (Yellow), M (Magenta), C (Cyan) and K (Black)).

Next, referring to the schematic diagram shown in FIG. 2, the mechanical configuration of the image forming apparatus 100 will be detailed in the following.

A paper sheet feeding section 150 picks up one of the recording paper sheets placed on a plurality of paper sheet feeding trays 150T and feeds it to the image forming position by using a pair of paper sheet feeding rollers.

A conveying section 160 is constituted by a pair of registration rollers, various kinds of conveyance rollers, a conveyance belt, etc., so as to convey the recording paper sheet, fed from the paper sheet feeding section 150, at a predetermined conveyance velocity. Further, conveyance sensors 160*s*, such as a leading edge detecting sensor to detect a leading edge of the recording paper sheet, etc., are disposed at predetermined positions of various portions of the conveying section 160.

To implement various kinds of operations for forming the image onto the recording paper sheet, a process unit 170, serving as the image forming section 170, is provided with: a charging section 171 to apply a predetermined electric charge onto the circumferential surface of the photoreceptor drum 173; an exposing section 172 to expose the photoreceptor drum based on image data; the photoreceptor drum 173 serving as the image bearing member onto which a electrostatic latent image is formed by the exposing operation; a developing section 174 to develop the electrostatic latent image with toner so as to form a toner image on the circumferential surface of the photoreceptor drum 173; an intermediate transfer member 175 serving as the other image bearing member onto which the toner image, formed on the photoreceptor drum 173, is transferred and which bears the transferred toner image thereon; and a transferring section 176.

Figure 2:
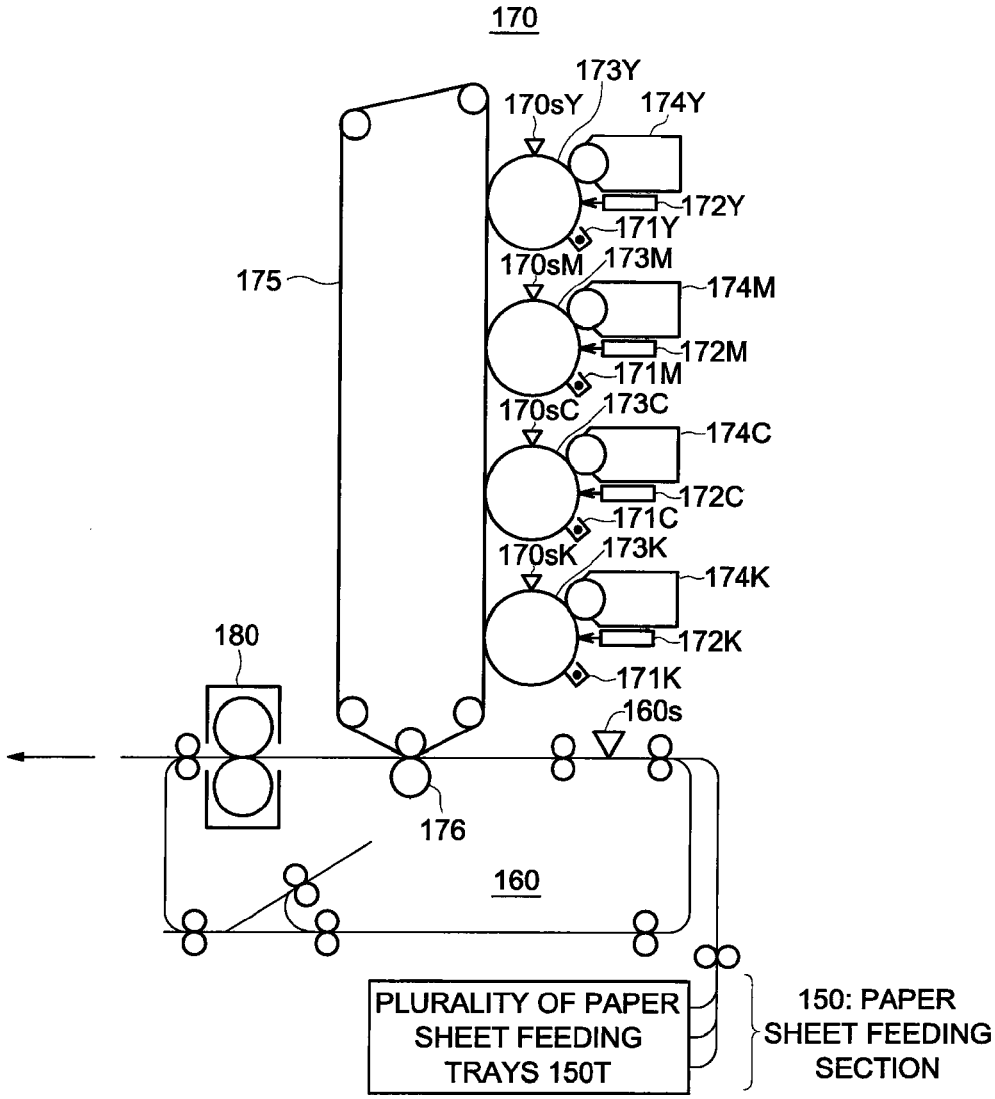
FIG. 2 shows a schematic diagram indicating another rough configuration of an image forming apparatus embodied in the present invention.

In this connection, when the image forming apparatus serves as the color image forming apparatus that forms a full color toner image by superimposing a plurality of unicolor toner images with each other, as shown in FIG. 2, the process unit 170 is provided with a plurality of charging sections 171, a plurality of exposing sections 172, a plurality of photoreceptor drum 173 and a plurality of developing sections 174 in such a manner that each combination of them corresponds to each of the unicolors (primary colors), so that the full color toner image is formed on the intermediate transfer member 175 by superimposing the unicolor toner images with each other, thereon, and finally, transferred onto the recording paper sheet.

Further, patch sensors 170*s*Y, 170*s*M, 170*s*C, 170*s*K, each of which detects a patch to be formed in a non-transfer area of the image bearing member, are respectively disposed at photoreceptor drums 173Y, 173M, 173C, 173K, each serving as the image bearing member. In this connection, although each of the patch sensors is provided for each of the photoreceptor drums in the present embodiment, it is also applicable that the patch detecting operation is performed on the intermediate transfer member 175.

A fixing section 180 applies heat and pressure onto the recording paper sheet onto which the toner image is transferred, while conveying the recording paper sheet in a state of tightly clipping it, so as to implement the fixing operation for mating the toner image stably fixed onto the recording paper sheet <Operations in Present Embodiment (1)>

Figure 3:
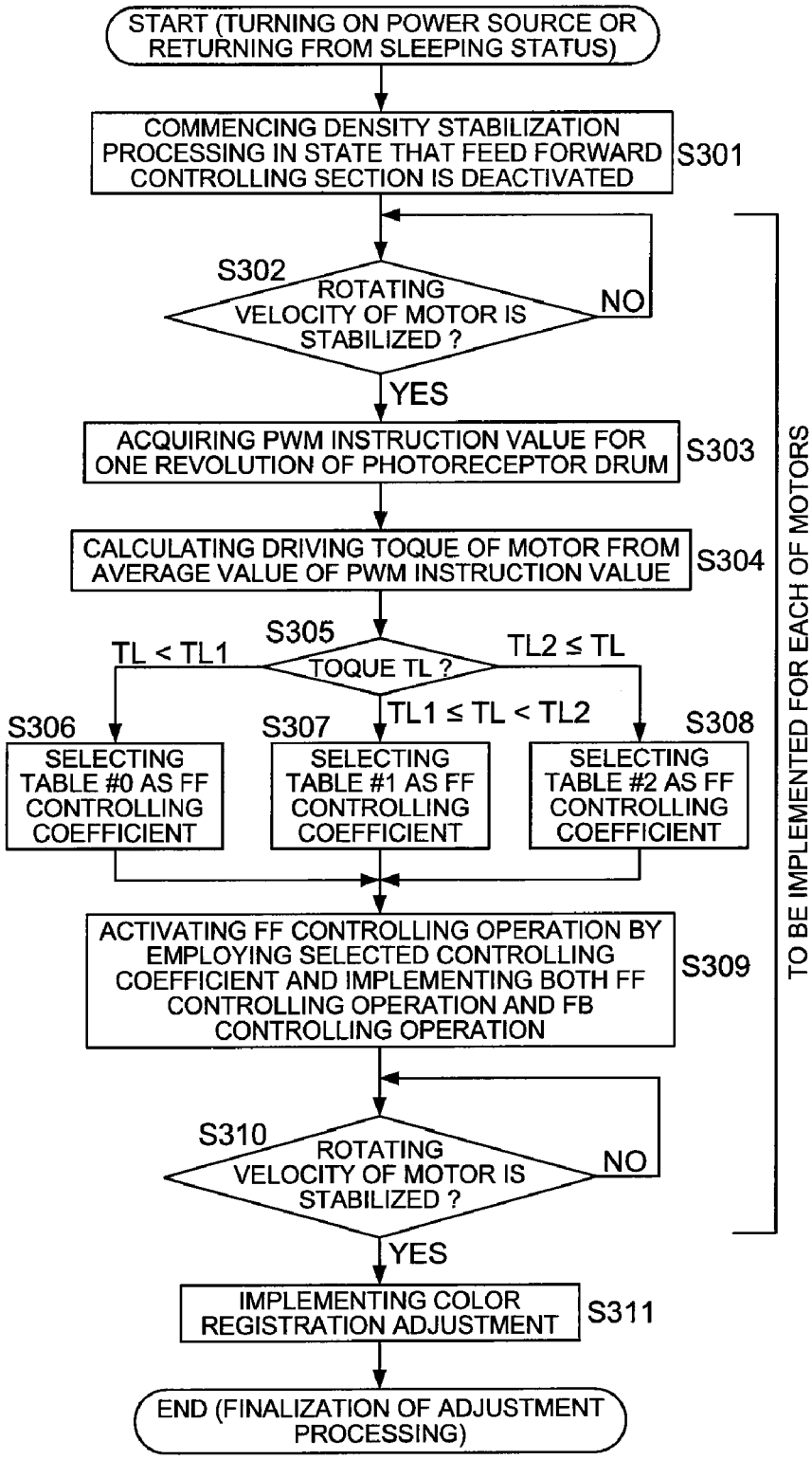
FIG. 3 shows a flowchart indicating consecutive operations to be conducted in an image forming apparatus embodied in the present invention.

Receiving an instruction for turning ON the power source or returning from the sleeping status, from the operating section (not shown in the drawings), the control section 101 outputs a command for commencing the density stabilization processing as an mode instruction, to the motor controlling section 110 and the other concerned sections (not shown in the drawings) (Step S301 in the flowchart shown in FIG. 3).

The abovementioned density stabilization processing is defined as such a processing that makes the concerned sections perform initial operations at the time when the power source is turned ON, so as to form a density patch on the photoreceptor drum by exposing it based on the data of the predetermined signal value, and then, detects whether or not the density of the concerned density patch is within a predetermined range by using the density sensor so as to adjust the concerned sections based on the detected result.

In this connection, although only a single kind of configuration is indicated in the schematic diagrams shown in FIG. 1 and FIG. 2, the same processing is applied to each of the motors equipped in each of the image forming sections 170Y, 170M, 170C, 170K, which respectively correspond to the unicolors and are installed in the image forming apparatus 100, in the motor controlling section 110 corresponding to each of the motors.

Further, in the motor controlling section 110, receiving the mode instruction command in regard to the density stabilization processing, the mode controlling section 1101 makes the feed forward controlling operation to be conducted by the feed forward controlling section 1110 deactivate, while makes the feedback controlling operation to be conducted by the feedback controlling section 1120 activate so as to implement the density stabilization processing. In this connection, any one of various kinds of controlling methods, such as a P controlling method, an I controlling method, a PI controlling method, a PID (Proportional Integral Derivative) controlling method, etc., may be employed as the feedback controlling operation to be conducted in the feedback controlling section 1120, as needed.

In the abovementioned case, based on the PWM instruction value outputted from the feedback controlling section 1120 in response to the velocity instruction command sent from the control section 101, the motor driving section 1710 generates PWM driving signals so as to rotate the motor 1720 at the predetermined rotation number. In other words, since the toque of the motor 1720 is unknown at this stage, the rotating action of the motor 1720 is controlled by using the feedback controlling operation, instead of the feed forward controlling operation.

In this connection, as detailed later, until the feed forward control has become effective as a result of the toque detecting operation, only the feedback controlling operation is activated. In this state, only the adjustments being processable within a range of each of the unicolors, such as a density adjustment for each of the unicolors, etc., are implemented, while the other adjustments pertaining to relative relationships between the unicolors, such as a color registration adjustment, etc., are made to deactivated.

Successively, with respect to each of the unicolors, the mode controlling section 1101 monitors the motor rotation velocity signals acquired from the motor 1720 so as to determine whether or not the rotating velocity of the motor 1720 is stabilized, during a period of implementing the density stabilization processing (Step S302 indicated in the flowchart shown in FIG. 3).

Still successively, when the mode controlling section 1101 confirms that the rotating velocity of the motor 1720 is stabilized with respect to every one of all of the unicolors (Step S302; Yes, indicated in the flowchart shown in FIG. 3), the mode controlling section 1101 instructs the feed forward controlling section 1110 to acquire the PWM instruction value for one revolution of the photoreceptor drum 173 so as to detect the toque concerned (Step S303 indicated in the flowchart shown in FIG. 3). In this connection, since only the feedback controlling operation is activated at this time point, the mode controlling section 1101 employs a reference rang, being wider than that at the normal operating time, for determining whether or not the rotating velocity of the motor 1720 is stabilized. For instance, although the reference range should be established as a range of ±0.5% for determining that the rotating velocity is stabilized at the normal operating time, the reference range at this time point is established as a range of ±1.0%.

In response to the instruction sent from the mode controlling section 1101, the toque detecting section 1112, included in the feed forward controlling section 1110, calculates the electric power to be supplied to the motor 1720 and the rotating velocity (rotation number) of the motor from the PWM instruction value to be fed to the motor driving section 1710, and further, calculates the driving toque of the motor by dividing the above-calculated electric power by the rotation number (Step S304 indicated in the flowchart shown in FIG. 3).

In this connection, the driving toque is calculated from the electric power to be supplied to the motor 1720 and the rotating velocity, and an average value derived by averaging the above-calculated driving toque for one revolution of the photoreceptor drum is employed. Accordingly, since the averaged value can be calculated in a state that it includes a periodical fluctuating component, it becomes possible to appropriately find the toque concerned, even if the fluctuation of the driving toque is generated, due to the variation of the load applied to the photoreceptor drum.

Herein, it is assumed that various toques of the motor are classified into three stages, namely, the first stage is defined as a normal range being equal to or greater than TL1 and smaller than TL2 (TL1≦TL<TL2), the second stage is defined as a smaller state being smaller than TL1 (TL<TL1) and the third stage is defined as a greater state being greater than TL2 (TL2<TL). In this connection, another classification may be also applicable, as well.

The parameter storage section 1113 retains the parameters based on the driving error for one revolution of the photoreceptor drum acquired in the past, as such the parameters that are necessary to eliminate (cancel) the periodical velocity fluctuation of the photoreceptor drum 173, having a repeatability. The parameters retained in the parameter storage section 1113 respectively correspond to gain values being different from each other, so as to make the parameters respectively correspond to the different motor toques without generating any deficiency and excess.

In this connection, it is also applicable that the parameter storage section 1113 is so constituted that the parameter storage section 1113 extracts the parameter from the periodical velocity fluctuation, extracted in midcourse of operating the image forming apparatus 100 by the filter section 1111, and the toque detected by the toque detecting section 1112, and retains the above-extracted parameter.

In this connection, the parameters that correspond to gain values being different from each other and correspond to the different motor toques without generating any deficiency and excess are defined as such parameters that make the feed forward controlling operation appropriately implemented for every toque in response to the toque fluctuation of the motor 1720 as indicated by the graphs shown in FIG. 5*a* through FIG. 5*d*, without making the feed forward controlling operation excessively implemented as indicated by the graphs shown in FIG. 6*a* through FIG. 6*d*, or, on the contrary, insufficiently implemented.

Incidentally, as a modified example of the abovementioned, it is also applicable that, with respect to a single kind of parameter, coefficient values corresponding to the various toques of the motor 1720 are retained in advance, so as to generate the parameter corresponding to the current motor toque by multiplying the single kind of parameter by a coefficient value corresponding to the detected toque.

Returning to the present embodiment, the parameter storage section 1113 selects an appropriate parameter corresponding to the toque of motor 1720, detected by the toque detecting section 1112, from the parameters retained therein, and output the selected parameter to the reverse-phase component creating section 1114.

In the above-operation, when the toque TL detected by the toque detecting section 1112 falls into the normal range being equal to or greater than TL1 and smaller than TL2 (Step S305; TL1≦TL<TL2 indicated in the flowchart shown in FIG. 3), the parameter storage section 1113 selects a Table #1, so as to output the parameter corresponding to the toque within the normal range as a feed forward controlling coefficient (hereinafter, referred to as an FF controlling coefficient) to the reverse-phase component creating section 1114 (Step S307 indicated in the flowchart shown in FIG. 3)

On the other hand, when the toque TL detected by the toque detecting section 1112 is smaller than TL1 (Step S305; TL<TL1, indicated in the flowchart shown in FIG. 3), the parameter storage section 1113 selects a Table #0, so as to output the parameter corresponding to the smaller toque as the FF controlling coefficient to the reverse-phase component creating section 1114 (Step S306 indicated in the flowchart shown in FIG. 3).

On the other hand, when the toque TL detected by the toque detecting section 1112 is equal to or greater than TL2 (Step S305; TL2≦TL, indicated in the flowchart shown in FIG. 3), the parameter storage section 1113 selects a Table #2, so as to output the parameter corresponding to the greater toque as the FF controlling coefficient to the reverse-phase component creating section 1114 (Step S308 indicated in the flowchart shown in FIG. 3).

In this connection, in the case of such the configuration that, with respect to the single kind of parameter, the coefficient values corresponding to the various toques of the motor 1720 are retained in advance, so as to generate the parameter corresponding to the current motor toque by multiplying the single kind of parameter by the coefficient value corresponding to the detected toque, it is applicable that the parameter corresponding to the current motor toque is generated by multiplying the single kind of parameter by the coefficient value corresponding to the detected toque, so as to output the parameter corresponding to the detected toque.

Successively, at the time when the table selecting operation is completed by the feed forward controlling section 1110, or after a predetermined time interval has elapsed since the PWM instruction value has been acquired (time interval required for calculating the toque and conducting the table selecting operation), the mode controlling section 1101 activates the feed forward controlling section 1110 by employing the parameter in the table selected corresponding to the detected toque.

Still successively, the mode controlling section 1101 implements both the feed forward controlling operation to be conducted by the feed forward controlling section 1110 and the feedback controlling operation to be conducted by the feedback controlling section 1120, so as to activate the motor controlling section 110 (Step S309 indicated in the flowchart shown in FIG. 3). In other words, at this stage, since the toque of the motor 1720 has been clarified, the rotation controlling operation of the motor 1720 is performed by implementing both the feed forward controlling operation and the feedback controlling operation.

In the above-operation, corresponding to the velocity instruction command sent from the control section 101, the reverse-phase instruction value sent from the feed forward controlling section 1110 and the detected results of the driving status of the motor and the photoreceptor drum, detailed later, the feedback controlling section 1120 outputs the PWM instruction signals so as to keep the rotating velocity of the photoreceptor drum 173 constant.

Still successively, the mode controlling section 1101 monitors the motor rotation velocity signal acquired from the motor 1720 so as to determine whether or not the rotating velocity of the motor 1720 is stabilized (Step S310 indicated in the flowchart shown in FIG. 3).

Further, at this time, since both the feed forward controlling operation and the feedback controlling operation are simultaneously implemented in parallel, instead of implementing only the feedback controlling operation, the mode controlling section 1101 changes the reference rang, currently set at a wider range, back to that at the normal operating time, for instance, from the range of ±1.0%, established in Step S302, to the normal rage of ±0.5%.

Still successively, at the time point when the mode controlling section 1101 confirms that the rotating velocity of the motor 1720 is stabilized for every one of all of the unicolors in the state that both the feed forward controlling operation and the feedback controlling operation are activated (Step S310; Yes, indicated in the flowchart shown in FIG. 3), the mode controlling section 1101 notifies the control section 101 of the fact that the rotating velocity of the motor 1720 is stabilized in the state that both the feed forward controlling operation and the feedback controlling operation are activated.

Receiving the above mentioned notification, the control section 101 controls the concerned sections so as to implement the color registration adjustment (Step S311 indicated in the flowchart shown in FIG. 3). For instance, under the controlling actions conducted by the control section 101, an image processing section or the like (not shown in the drawings) creates a predetermined color-deviation detecting pattern, and an image of the above-created color deviation detecting pattern is formed at a predetermined timing, so as to detect a state of color deviations in the image. Incidentally, since the abovementioned color registration adjustment is one of the well-known technologies, detailed explanations for it will be omitted.

Yet successively, completing the operations in regard to the relative relationships between the unicolor images, such as the color registration adjustment, etc., the control section 101 completes the density stabilization processing, and then, makes the image forming apparatus 100 shift to the normal image forming mode (END indicated in the flowchart shown in FIG. 3).

According to the present embodiment described in the foregoing, since the parameters being appropriate for the feed forward controlling operation can be selected corresponding to the toques of the motors, even when the fluctuations of driving toques are generated due to the load variations of the photoreceptor drums 173, it becomes possible to appropriately apply the feed forward controlling operation to every one of the motors.

As a result, when the feed forward controlling operation is employed for eliminating the velocity fluctuation of the photoreceptor drum 173, it becomes possible to appropriately control the feed forward controlling operation without generating any malfunction, such as a controlling failure, etc.

Further, since no malfunction, such as a controlling failure, etc., would occur when the feed forward controlling operation is employed for eliminating the velocity fluctuation of the photoreceptor drum 173, it becomes unnecessary to set the gain of the feed forward control system in advance at a lower value in fear of causing a malfunction, such as the oscillation, etc., and, by employing the appropriate parameters, it becomes possible not only to heighten the effect of the feed forward controlling operation, but also to obtain such an effect that the periodical velocity fluctuation can be speedily suppressed.

Still further, after the concerned parameters are selected, the color registration adjustment is performed in such the state that the photoreceptor drum is driven by implementing both the feed forward controlling operation in which the selected parameters are employed and the feedback controlling operation. Accordingly, since the feed forward controlling operation can be implemented without being influenced by the load fluctuation of the photoreceptor drum 173, it becomes possible to accurately perform the color registration adjustment in the state that the photoreceptor drum 173 is driven to rotate at a constant velocity.

Yet further, since the aforementioned embodiment does not require such a complicated processing that measures a transfer function or the hie, neither wasted operating time nor wasted calculating time is necessary.

<Operations in Present Embodiment (2)>

Next, the operations in the present embodiment (2) will be detailed in the following.

In "OPERATIONS IN PRESENT EMBODIMENT (1)" aforementioned, the processing to be conducted at the time of the density stabilization processing after the power source is turned ON has been described. Successively, in "OPERATIONS IN PRESENT EMBODIMENT (2)", the other processing to be conducted at the time of the normal image forming operation will be detailed in the following.

In spite of the fact that the parameters to be used for the feed forward controlling operation are selected corresponding to the toques detected by the toque detecting section 1112 according to the "OPERATIONS IN PRESENT EMBODIMENT (1)" aforementioned, and are employed so as to appropriately implement the feed forward controlling operation, as the time has elapsed, sometimes, the abrasive load, to be generated between the circumferential surface of the photoreceptor drum and the cleaning blade, would widely fluctuate, due to various kinds of factors, such as changes of environmental conditions, an image forming history, aging variation of characteristics of the cleaning blade, etc., To cope with the above-problem, the toque of the motor is also monitored during the image forming operation, so that the selection of the parameters for the feed forward controlling operation is changed when the toque of the motor is fluctuated.

Figure 4:
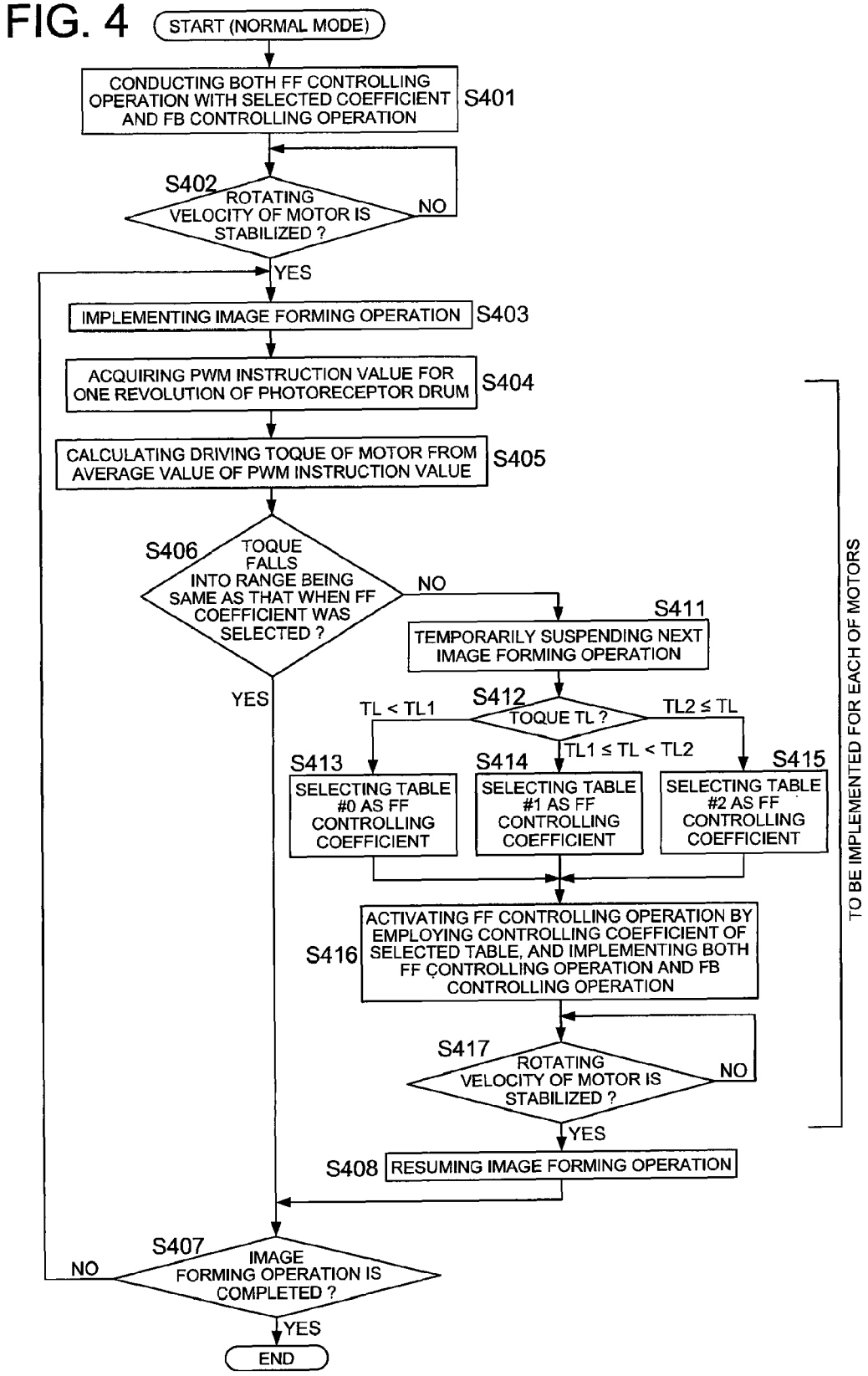
FIG. 4 shows a flowchart indicating other consecutive operations to be conducted in an image forming apparatus embodied in the present invention.
Figure 5A:
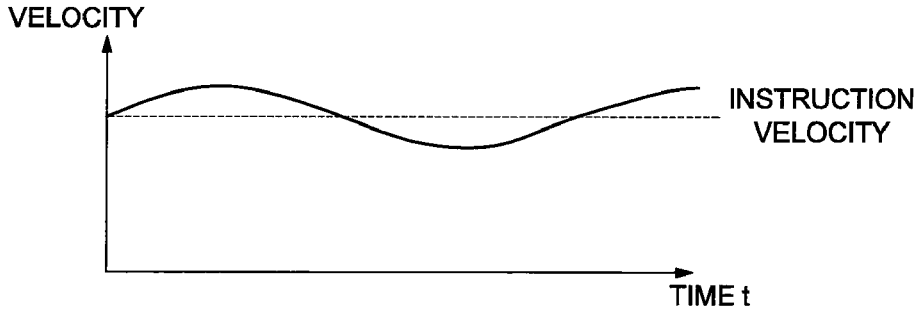
FIG. 5*a*, FIG. 5*b*, FIG. 5*c* and FIG. 5*d* show graphs indicating canceling processes to be performed hi the feed forward controlling operation.
Figure 5B:
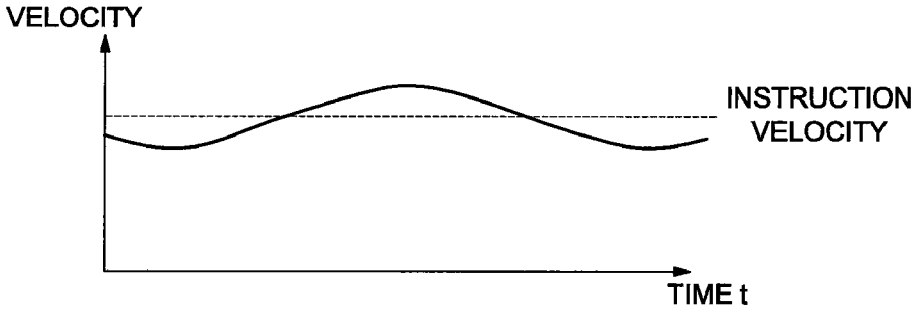
Figure 5C:
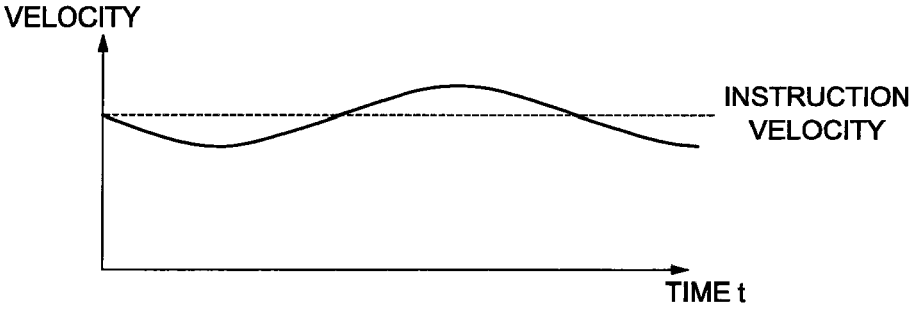
Figure 5D:
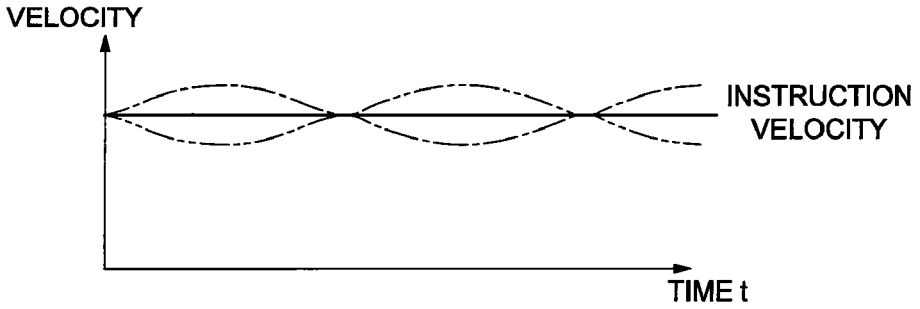
Figure 6A:
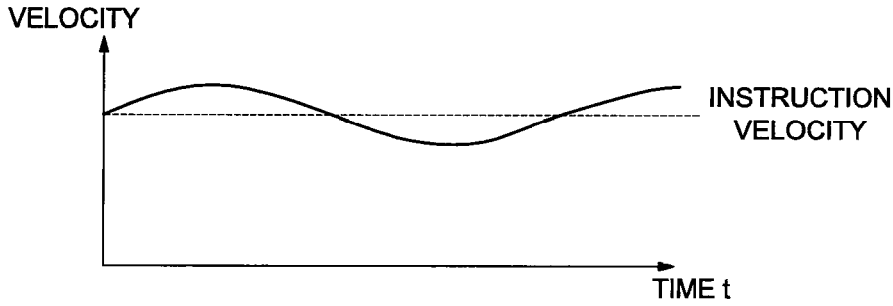
FIG. 6*a*, FIG. 6*b*, FIG. 6*c* and FIG. 6*d* show graphs indicating other canceling processes to be performed in the feed forward controlling operation.
Figure 6B:
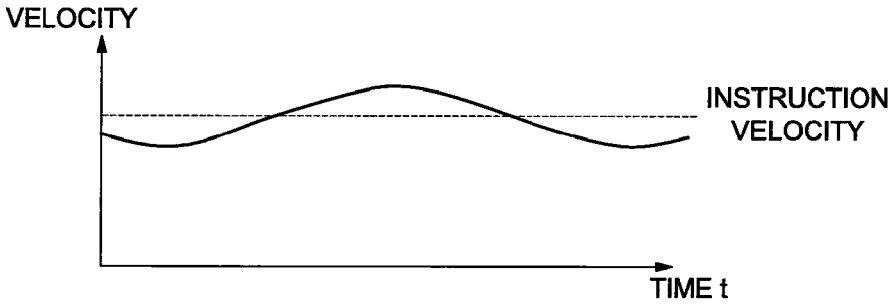
Figure 6C:
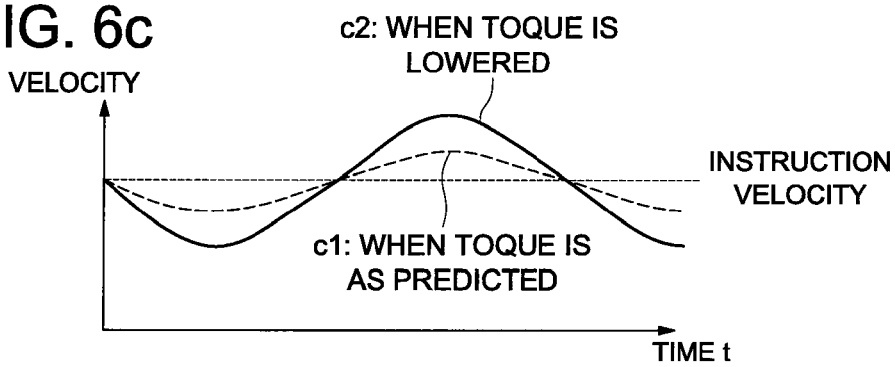
Figure 6D:
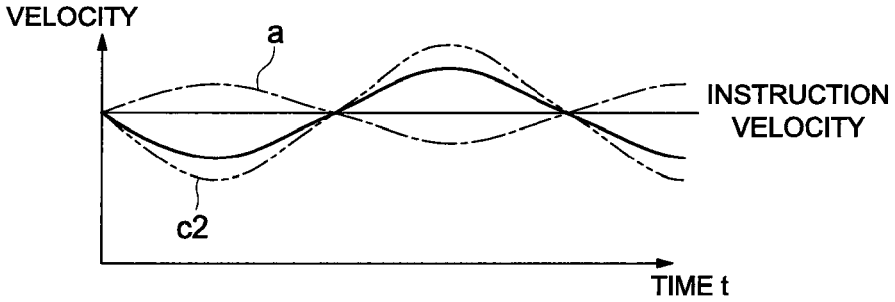

During the image forming operation, the mode controlling section 1101 makes the motor controlling section 110 conducts both the feed forward controlling operation to be performed by the feed forward controlling section 1110 and the feedback controlling operation to be performed by the feedback controlling section 1120 (Step S401 indicated in the flowchart shown in FIG. 4). In other words, at this stage, as described in the "OPERATIONS IN PRESENT EMBODIMENT (1)", since the toque of the motor 1720 is clarified in the density stabilization processing, the operation for controlling the rotation of the motor 1720 in the normal image forming operation is performed by implementing both the feed forward controlling operation and the feedback controlling operation.

On that occasion, in response to the velocity instruction value sent from the control section 101, the reverse instruction value sent from the feed forward controlling section 1110, and the detected result of the driving status of the motor and/or the photoreceptor drum (rotating velocity of the motor, rotating velocity of the photoreceptor drum), detailed later, the feedback controlling section 1120 outputs the PWM instruction value so as to keep the rotating velocity of the photoreceptor drum 173 constant.

Successively, with respect to each of the unicolors, the mode controlling section 1101 monitors the motor rotation velocity signals acquired from the motor 1720, so as to determine whether or not the rotating velocity of the motor 1720 is stabilized (Step S402 indicated in the flowchart shown in FIG. 4).

Still successively, at the time point when the mode controlling section 1101 confirms that the rotating velocity of the motor 1720 is stabilized for every one of all of the unicolors in the state that both the feed forward controlling operation and the feedback controlling operation are activated (Step S402; Yes, indicated in the flowchart shown in FIG. 4), the mode controlling section 1101 notifies the control section 101 of the fact that the rotating velocity of the motor 1720 is stabilized in the state that both the feed forward controlling operation and the feedback controlling operation are activated.

Receiving the abovementioned notification, the control section 101 controls the concerned sections so as to implement the image forming operation based on the image data (Step S403 indicated in the flowchart shown in FIG. 4).

Still successively, when the mode controlling section 1101 confirms that the rotating velocity of the motor 1720 is stabilized (Step S402; Yes, indicated in the flowchart shown in FIG. 4), the mode controlling section 1101 instructs the feed forward controlling section 1110 to acquire the PWM instruction value for one revolution of the photoreceptor drum 173 so as to detect the toque concerned (Step S404 indicated in the flowchart shown in FIG. 4).

In response to the instruction sent from the mode controlling section 1101, the toque detecting section 1112, included in the feed forward controlling section 1110, calculates the electric power to be supplied to the motor 1720 and the rotating velocity (rotation number) of the motor from the PWM instruction value to be fed to the motor driving section 1710, and further, calculates the driving toque of the motor by dividing the above-calculated electric power by the rotation number (Step S405 indicated in the flowchart shown in FIG. 4)

Still successively, when the toque detected by the toque detecting section 1112 falls into a range being same as that of the table of the parameter that was previously selected and is currently used (Step S406; Yes, indicated in the flowchart shown in FIG. 4), the operations from "IMPLEMENTING IMAGE FORMING OPERATION" in Step S403 to "MONITORING DRIVING TOQUE OF MOTOR" in Step S404 through Step S406 are repeated until the image forming operation is completed (Step S407; Yes, indicated in the flowchart shown in FIG. 4).

On the other hand, when the toque detected by the toque detecting section 1112 falls into a range being different from that of the table of the parameter that was previously selected and is currently used (Step S406; No, indicated in the flowchart shown in FIG. 4), the mode controlling section 1101 notifies the control section 101 of the fact that a fluctuation of the toque has occurred. Receiving the above-notification in regard to the fluctuation of the toque, the control section 101 finalizes the image forming operation, which is currently in midcourse of its implementation, and temporarily suspends the commencement of the next image forming operation (Step S411 indicated in the flowchart shown in FIG. 4).

Still successively, when the toque TL detected by the toque detecting section 1112 falls into the range being equal to or greater than TL1 and smaller than TL2 (Step S412; TL1≦TL<TL2 indicated in the flowchart shown in FIG. 4), the parameter storage section 1113 selects a Table #1, so as to output the parameter corresponding to the toque within the normal range as the FF controlling coefficient to the reverse-phase component creating section 1114 (Step S414 indicated in the flowchart shown in FIG. 4)

On the other hand, when the toque TL detected by the toque detecting section 1112 is smaller than TL1 (Step S412; TL<TL1, indicated in the flowchart shown in FIG. 4), the parameter storage section 1113 selects a Table #0, so as to output the parameter corresponding to the smaller toque as the FF controlling coefficient to the reverse-phase component creating section 1114 (Step S413 indicated in the flowchart shown in FIG. 4).

On the other band, when the toque TL detected by the toque detecting section 1112 is greater than TL2 (Step S412; TL2<TL, indicated in the flowchart shown in FIG. 4), the parameter storage section 1113 selects a Table #2, so as to output the parameter corresponding to the greater toque as the FF controlling coefficient to the reverse-phase component creating section 1114 (Step S415 indicated in the flowchart shown in FIG. 4).

In this connection, in the case of such the configuration that, with respect to the single kind of parameter, the coefficient values corresponding to the various toques of the motor 1720 are retained in advance, so as to generate the parameter corresponding to the current motor toque by multiplying the single kind of parameter by the coefficient value corresponding to the detected toque, it is applicable that the parameter corresponding to the current motor toque is generated by multiplying the single kind of parameter by the coefficient value corresponding to the detected toque, so as to output the parameter corresponding to the detected toque.

Successively, at the time when the table selecting operation is completed by the feed forward controlling section 1110, or after a predetermined time interval has elapsed since the PWM instruction value has been acquired (time interval required for calculating the toque and conducting the table selecting operation), the mode controlling section 1101 activates the feed forward controlling section 1110 by employing the parameter in the table selected corresponding to the detected toque.

Still successively, the mode controlling section 1101 implements both the feed forward controlling operation to be conducted by the feed forward controlling section 1110 and the feedback controlling operation to be conducted by the feedback controlling section 1120, so as to activate the motor controlling section 110 (Step S416 indicated in the flowchart shown in FIG. 4). In other words, at this stage, since the fluctuation of the toque of the motor 1720 has been clarified, the parameter to be used in the feed forward controlling operation is selected corresponding to the toque after the fluctuation, and then, the rotation controlling operation of the motor 1720 is performed by implementing both the feed forward controlling operation and the feedback controlling operation.

In the above-operation, corresponding to the velocity instruction command sent from the control section 101, the reverse-phase instruction value sent from the feed forward controlling section 1110 and the detected results of the driving status of the motor and/or the photoreceptor drum (rotating velocity of the motor, rotating velocity of the photoreceptor drum), detailed later, the feedback controlling section 1120 outputs the PWM instruction signals so as to keep the rotating velocity of the photoreceptor drum 173 constant.

Still successively, with respect to each of the unicolors, the mode controlling section 1101 monitors the motor rotation velocity signal acquired from the motor 1720 so as to determine whether or not the rotating velocity of the motor 1720 is stabilized (Step S417 indicated in the flowchart shown in FIG. 4). At the time point when the mode controlling section 1101 confirms that the rotating velocity of the motor 1720 is stabilized for every one of all of the unicolors in the state that both the feed forward controlling operation and the feedback controlling operation are activated (Step S417; Yes, indicated in the flowchart shown in FIG. 4), the mode controlling section 1101 notifies the control section 101 of the fact that the rotating velocity of the motor 1720 is stabilized in the state that both the feed forward controlling operation and the feedback controlling operation are activated.

Receiving the abovementioned notification, the control section 101 controls the concerned sections so as to resume the image forming operation, which has been temporarily suspended (Step S418 indicated in the flowchart shown in FIG. 4). Then, the control section 101 repeats the consecutive operations of "IMPLEMENTING IMAGE FORMING OPERATION" in Step S403, "MONITORING DRIVING TOQUE OF MOTOR" in Step S404 through Step S406 and "CONTROLLING CONCERNED SECTIONS WHEN FLUCTUATION OF TOQUE IS DETECTED" in Step S411 through Step S418, which are indicated in the flowchart shown in FIG. 4, until the image forming operation is completed (Step S407; Yes, indicated in the flowchart shown in FIG. 4).

In this connection, in the abovementioned embodiment, the fluctuation of the toque has been monitored in midcourse of implementing the image forming operation, so as to select the parameter when the above image-forming operation is completed. However, the scope of the present invention is not limited to the abovementioned embodiment. Alternatively, it is also applicable that the system is so constituted that, even when the fluctuation of the toque has been detected, the operation for selecting the parameter is implemented in such a time interval in which the usage frequency is relatively small, such as a lunchtime, etc. By configuring the system as abovementioned, it becomes possible to eliminate such a period in which the image forming operation is deactivated even temporarily, resulting in a capability of suppressing the deterioration of the productivity.

According to the abovementioned embodiment, even when the fluctuation of the driving toque is generated in association with the fluctuation of the load applied to the photoreceptor drum 173, since the parameter being appropriate for the feed forward controlling operation is selected corresponding to the toque, it becomes possible to appropriately perform the feed forward controlling operation.

As a result, when the feed forward controlling operation is employed for eliminating the velocity fluctuation of the photoreceptor drum 173, it becomes possible to appropriately control the feed forward controlling operation without generating any malfunction, such as a controlling failure, etc.

Further, since no malfunction, such as a controlling failure, etc., would occur when the feed forward controlling operation is employed for eliminating the velocity fluctuation of the photoreceptor drum 173, it becomes unnecessary to set the gain of the feed forward control system in advance at a lower value in fear of causing a malfunction, such as the oscillation, etc., and, by employing the appropriate parameters, it becomes possible not only to heighten the effect of the feed forward controlling operation, but also to obtain such an effect that the periodical velocity fluctuation can be speedily suppressed.

Still further, in the abovementioned embodiment, the driving toque of the motor is measured in advance in midcourse of implementing the image forming operation. Then, when the above-measured driving toque is varied from the previous driving toque, which was measured at the time of parameter selecting operation, and the difference between them is equal to or greater than a certain predetermined value, another parameter is reselected, so as to make the reselected parameter effective after the currant image forming operation is completed. Accordingly, even when the fluctuation of the driving toque is generated in association with the fluctuation of the load applied to the photoreceptor drum 173, since the parameter, being appropriate for the feed forward controlling operation, is selected corresponding to the toque concerned, it becomes possible to appropriately perform the feed forward controlling operation. As a result, when the feed forward controlling operation is employed for eliminating the velocity fluctuation of the photoreceptor drum 173, it becomes possible to appropriately control the feed forward controlling operation without generating any malfunction, such as a controlling failure, etc.

Still further, in the abovementioned embodiment, the driving toque of the motor is measured in advance in midcourse of implementing the image forming operation. Then, when the above-measured driving toque is varied form the previous driving toque, which was measured at the time of parameter selecting operation, and the difference between them is equal to or greater than a certain predetermined value, another parameter is reselected, so as to make the reselected parameter effective after the current image forming operation is completed. After that, the next image forming operation is implemented after both the feed forward controlling operation, in which the reselected parameter is employed, and the feedback controlling operation have entered into the stable state. Accordingly, even when the fluctuation of the driving toque is generated in association with the fluctuation of the load applied to the photoreceptor drum 173, since the parameter, being appropriate for the feed forward controlling operation, is selected corresponding to the toque concerned, it becomes possible to appropriately perform the feed forward controlling operation. As a result, when the feed forward controlling operation is employed for eliminating the velocity fluctuation of the photoreceptor drum 173, it becomes possible to appropriately control the feed forward controlling operation without generating any malfunction, such as a controlling failure, etc.

In this connection, according to the abovementioned embodiment, the driving toque is calculated from the electric power to be supplied to the motor 1720 and the rotating velocity of the motor, and an average value derived by averaging the above-calculated driving toque for one revolution of the photoreceptor drum is employed. Accordingly, since the averaged value can be calculated in a state that it includes a periodical fluctuating component, it becomes possible to appropriately find the toque concerned, even if the fluctuation of the driving toque is generated, due to the variation of the load applied to the photoreceptor drum.

Yet further, according to the abovementioned embodiment, since the aforementioned embodiment does not require such a complicated processing that measures a transfer function or the like, neither wasted operating time nor wasted calculating time is necessary.

In this connection, although the case that the motor 1720 is the DC motor to be controlled by the PWM (Pulse Width Modulation) method has been exemplified in the abovementioned embodiment, the scope of the present invention is not limited to the abovementioned embodiment The present invention may be also applicable to various kinds of controlling method to be employed for controlling various kinds of motors.

According to the present invention described in the foregoing, the following effect can be attained.

(1) According to the invention recited in claim 1, the control section of image forming apparatus is provided with the feed forward controlling section and the feed forward controlling section to control the driving motor so as to drive the photoreceptor member at a constant velocity. During the initial operating time, the control section deactivates the feed forward controlling section, while only activates the feedback controlling section to drive the photoreceptor member so as to measure the driving toque of the driving motor, and selects the first parameter from the parameters, corresponding to the driving toque measured. Then, after the first parameter is selected, the control section activates both the feed forward controlling section, which employs the first parameter, and the feedback controlling section, to drive the photoreceptor member so as to conduct the image forming operation for forming the image thereon.

Accordingly, since the parameter being appropriate for the feed forward controlling operation can be selected corresponding to the toque of the motor, even when the fluctuation of the driving toque is generated due to the load variation of the photoreceptor drum, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

(2) According to the invention recited in claim 2, after the concerned parameter is selected, the control section implements the color registration adjustment in such a state that both the feed forward controlling section, which employs the first parameter, and the feedback controlling section are activated to drive the photoreceptor member.

Accordingly, since the feed forward controlling operation can be implemented without being influenced by the load fluctuation of the photoreceptor drum, it becomes possible to accurately perform the color registration adjustment in the state that the photoreceptor drum is driven to rotate at a constant velocity.

(3) According to the invention recited in claim 3, the control section measures the currently driving toque of the driving motor in midcourse of conducting the image forming operation. Then, in the case that the currently driving toque, measured in midcourse of conducting the image forming operation, is varied from the driving toque measured at the time point when the first parameter was selected, and the difference between the currently driving toque and the driving toque is equal to or greater than the predetermined value, the control section reselects a second parameter from the parameters.

Accordingly, since the parameters being appropriate for the feed forward controlling operation can be selected corresponding to the toque of the motor, even when the fluctuation of the driving toque is generated due to the load variation of the photoreceptor drum, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

(4) According to the invention recited in claim 4, the control section measures the currently driving toque of the driving motor in midcourse of conducting the image forming operation. Then, in the case that the currently driving toque, measured in midcourse of conducting the image forming operation, is varied from the driving toque measured at the time point when the first parameter was selected, and the difference between the currently driving toque and the driving toque is equal to or greater than the predetermined value, the control section reselects a second parameter from the parameters. Successively, the control section makes the second parameter effective, after the image forming operation, being currently implemented, is completed.

Accordingly, since the parameters being appropriate for the feed forward controlling operation can be selected corresponding to the toque of the motor, even when the fluctuation of the driving toque is generated due to the load variation of the photoreceptor drum, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

(5) According to the invention recited in claim 5, the control section measures the currently driving toque of the driving motor in midcourse of conducting the image forming operation. Then, in the case that the currently driving toque, measured in midcourse of conducting the image forming operation, is varied from the driving toque measured at the time point when the first parameter was selected, and the difference between the currently driving toque and the driving toque is equal to or greater than the predetermined value, the control section reselects a second parameter from the parameters. Successively, the control section makes the second parameter effective, after the image forming operation, being currently implemented, is completed. Still successively, the control section implements a next image forming operation in such a state that both the feed forward controlling section, which employs the second parameter, and the feedback controlling section are stabilized after the second parameter is made to be effective.

Accordingly, since the parameters being appropriate for the feed forward controlling operation can be selected corresponding to the toque of the motor, even when the fluctuation of the driving toque is generated due to the load variation of the photoreceptor drum, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

(6) According to the invention recited in claim 6, the control section calculates the driving toque from the PWM instruction value to be fed to the driving motor and the velocity value of the driving motor.

Accordingly, since the toque of the motor can be appropriately found, even when the fluctuation of the driving toque is generated due to the load variation of the photoreceptor drum occurring in midcourse of the image forming operation, the parameters being appropriate for the feed forward controlling operation can be selected corresponding to the toque of the motor, and accordingly, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

(7) According to the invention recited in claim 7, the control section calculates the driving toque from the PWM instruction value to be fed to the driving motor and the velocity value of the driving motor. Then, with respect to the driving toque calculated, the control section employs a value found by averaging toque for one revolution of the photoreceptor member.

Accordingly, since the averaged value can be calculated in the state that it includes a periodical fluctuating component, even when the fluctuation of the driving toque is generated due to the load variation of the photoreceptor drum occurring in midcourse of the image forming operation, the parameters being appropriate for the feed forward controlling operation can be selected corresponding to the toque of the motor, and accordingly, it becomes possible to appropriately apply the feed forward controlling operation to the motor. As a result, when the feed forward controlling operation is employed for eliminating the velocity fluctuation of the photoreceptor drum, it becomes possible to appropriately control the feed forward controlling operation without generating any malfunction, such as a controlling failure, etc.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising a photoreceptor member that is driven by a driving motor to form an image thereon; and a control section to control the driving motor so as to drive the photoreceptor member at a constant velocity;

wherein the control section is provided with:

a feed forward controlling section that stores parameters derived from driving errors for one revolution of the photoreceptor member, acquired in a past, so as to create a reverse-phase instruction value for canceling a driving error, based on one of the parameters; and a feedback controlling section that controls a velocity of the photoreceptor member, corresponding to a velocity instruction value, the reverse-phase instruction value and a detected result of a driving status of the photoreceptor member, so as to keep the velocity of the photoreceptor member constant; and wherein, during an initial operating time, the control section deactivates the feed forward controlling section, while only activates the feedback controlling section to drive the photoreceptor member so as to measure a driving toque of the driving motor, and selects a first parameter from the parameters, corresponding to the driving toque measured; and wherein, after the first parameter is selected, the control section activates both the feed forward controlling section, which employs the first parameter, and the feedback controlling section, to drive the photoreceptor member so as to conduct an image forming operation for forming the image thereon.

2. The image forming apparatus of claim 1, wherein the control section controls various kinds of concerned sections provided in the image forming apparatus, so as to implement a color registration adjustment in such a state that both the feed forward controlling section, which employs the first parameter, and the feedback controlling section are activated to drive the photoreceptor member.

3. The image forming apparatus of claim 1, wherein the control section measures a currently driving toque of the driving motor in midcourse of conducting the image forming operation; and wherein, in a case that the currently driving toque, measured in midcourse of conducting the image forming operation, is varied from the driving toque measured at a time point when the first parameter was selected, and a difference between the currently driving toque and the driving toque is equal to or greater than a predetermined value, the control section reselects a second parameter from the parameters.

4. The image forming apparatus of claim 3, wherein the control section makes the second parameter effective, after the image forming operation, being currently implemented, is completed.

5. The image forming apparatus of claim 4, wherein the control section implements a next image forming operation in such a state that both the feed forward controlling section, which employs the second parameter, and the feedback controlling section are stabilized after the second parameter is made to be effective.

6. The image forming apparatus of claim 1, wherein the control section calculates the driving toque from a PWM (Pulse Width Modulation) instruction value to be fed to the driving motor and a velocity value of the driving motor.

7. The image forming apparatus of claim 6, wherein, with respect to the driving toque calculated, the control section employs a value found by averaging toque for one revolution of the photoreceptor member.

* * * * *